United States Patent [19]

Kulischenko

[11] 4,327,658

[45] May 4, 1982

[54] MARINE STEERING SYSTEM

[75] Inventor: Walter Kulischenko, East Brunswick, N.J.

[73] Assignee: Pennwalt Corporation, Philadelphia, Pa.

[21] Appl. No.: 172,102

[22] Filed: Jul. 25, 1980

[51] Int. Cl.[3] ..... B63H 21/26

[52] U.S. Cl. ..... 114/146; 114/144 R; 440/53; 440/59; 74/504

[58] Field of Search ..... 74/665 A–665 E, 74/504, 507; 280/321–323; 64/6, 2 R; 114/144 R, 144 A, 146; 440/53, 58, 59, 62

[56] References Cited

U.S. PATENT DOCUMENTS

| | | | |
|---|---|---|---|
| 3,208,300 | 9/1965 | Morse | 114/144 R |
| 3,422,784 | 1/1969 | Becker | 114/146 |
| 3,863,593 | 2/1975 | Borst | 440/59 |
| 3,922,995 | 12/1975 | Kroll | 440/58 |
| 3,958,524 | 5/1976 | Cantley | 114/146 |
| 4,173,937 | 11/1979 | Kulischenko | 114/144 R |

*Primary Examiner*—Trygve M. Blix
*Assistant Examiner*—D. W. Keen

[57] ABSTRACT

A marine vessel is provided with substantially identical steering mechanisms at a main deck dashboard and flying bridge, for example. The vessel may be steered from either location by flexible shafting interconnecting the two steering mechanisms. No gears of servomechanisms are required in the entire steering system, although a modification of the invention discloses a conventional T-coupling device employing bevel gears therein for coupling the outputs of each steering mechanism to a common output which controls the rudder. Structure is disclosed for disengaging that steering wheel not actually steering.

3 Claims, 6 Drawing Figures

MARINE STEERING SYSTEM

CROSS-REFERENCE TO OTHER RELATED APPLICATIONS

Reference is hereby made to copending patent application of W. Kulischenko for "Marine Vessel Safeguard Steering Mechanism", Ser. No. 015,830, filed Feb. 28, 1979, now U.S. Pat. No. 4,173,937, assigned to the present assignee.

STATEMENT OF THE INVENTION

This invention relates to dual steering capabilities of a marine vessel from either the main deck or flying bridge, for example.

BACKGROUND AND SUMMARY OF THE INVENTION

Marine steering systems employing remotely actuated rotatable flexible shafts are known. The driving element of such systems is usually an output shaft of a device which has been appropriately "stepped-up" by suitable gearing mechanism. The stepped-up output is then fed into a rotatable flexible shaft. The driven element is usually a device which is capable of converting rotary motion from the rotatable flexible shaft to linear motion, and may comprise a ball screw cylinder, threaded screw, or the like. The linear motion is transmitted to a convenient output member which operates or controls the rudder or other steering mechanism.

Such gear mechanisms for stepping-up the output shaft are not smooth in operation, provide undesirable backlash and are somewhat noisy even when made from suitable non-metallic materials, as described in U.S. Pat. No. 4,173,937 to W. Kulischenko et al. While the present invention optionally employs a gear mechanism in the form of a device which directly couples the outputs of the steering mechanisms at the main deck dashboard and flying bridge, for example, to provide a common output which rotates the flexible shaft which controls the rudder, no such stepping-up of output shafts are contemplated by the present invention.

Other prior art dual steering systems employ electrical/mechanical servomechanisms which are rather costly, bulky, and require frequent maintenance and adjustment.

The present invention utilizes structure embodied in the abovediscussed U.S. Pat. No. 4,173,937; portions of the clutch mechanism described in the cross-referenced patent application; and rotatable flexible shaft means interconnecting output shafts of each steering mechanism to provide an unique dual steering system devoid of gearing and servomechanisms. The steering system is reliable, quiet, inexpensive, and substantially maintenance-free. Optionally, as aforementioned, the outputs may be coupled to a common output through a T-coupler which includes bevel gearing.

DETAILED DESCRIPTION OF THE DRAWINGS

Figure 1:
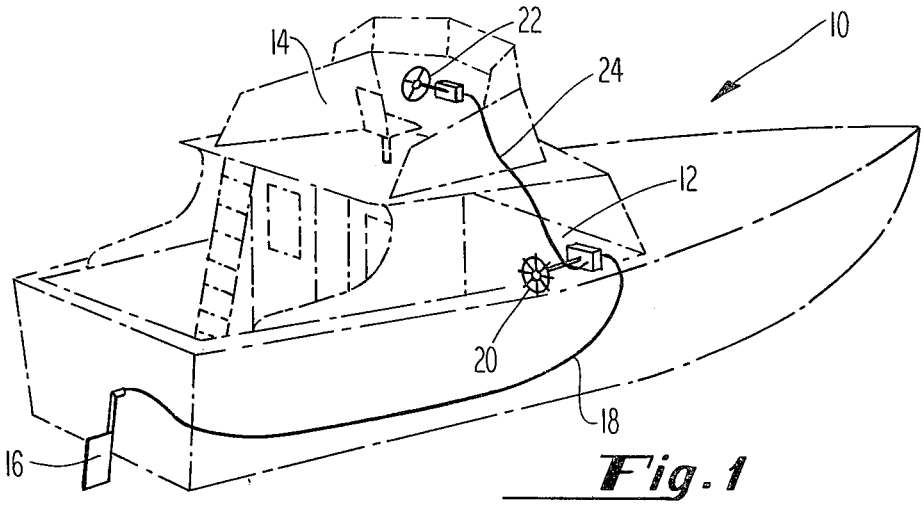
FIG. 1 is a diagrammatic perspective view of a fishing vessel employing the present steering system.

In FIG. 1, a deep-sea fishing vessel 10 is diagrammatically illustrated to include a main deck dashboard 12, a flying bridge 14, a steering member such as rudder 16 which is controlled by a rotatable flexible shaft 18 acting through a device which converts rotary motion from flexible shaft 18 to linear motion, such as a ball screw cylinder, for example, not shown, but shown and described in U.S. Pat. No. 4,173,937 to Kulischenko et al.

Manually-operable steering wheels 20 and 22 control rotation of flexible shaft 18 from main deck dashboard 12 and flying bridge 14 respectively, which steering wheels cooperate with substantially identical mechanisms, later described, and articulate with each other through a connecting rotatable shaft 24 interconnected therebetween. It is understood, of course, that more than two steering wheels may be employed in which case additional connecting rotatable flexible shafts will be required.

Figure 2:
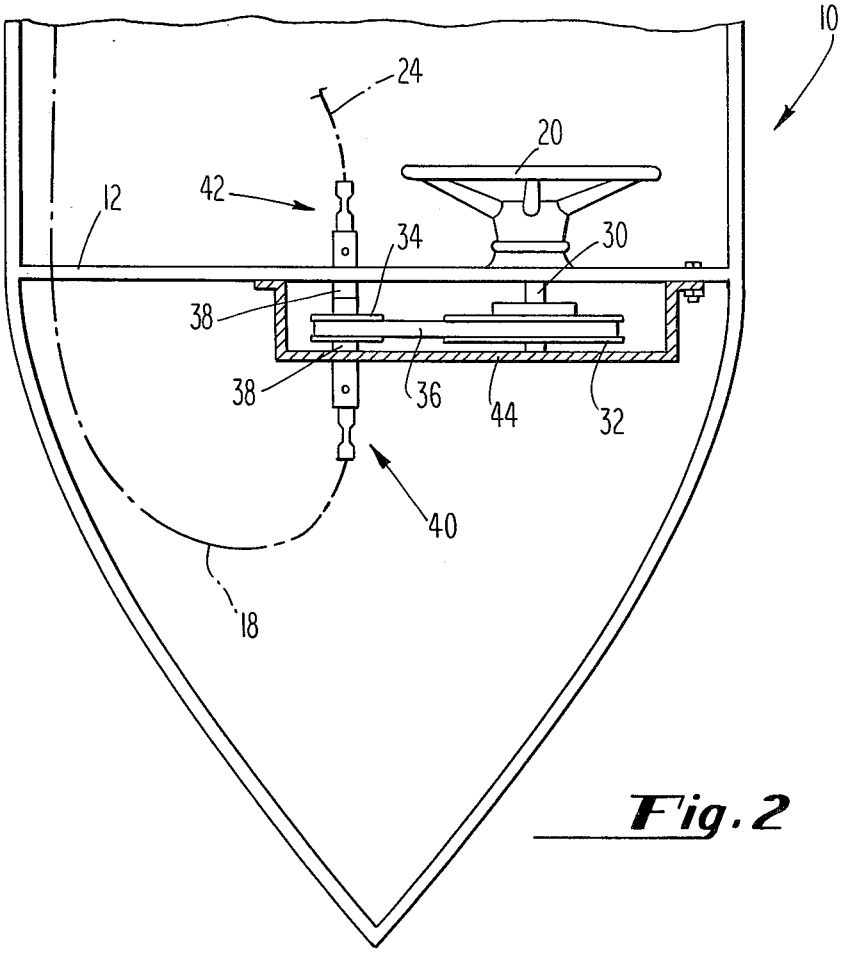
FIG. 2 is a plan view, partially sectioned, of an embodiment of the steering mechanism of the present invention.

The substantially identical mechanisms cooperating with steering wheels 20 and 22 will now be described. Thus, reference is made to FIG. 2 where the main deck dashboard steering mechanism is illustrated. Steering wheel shaft 30 is connected by conventional means to a driver pulley 32 such that one revolution of steering wheel 20 produces a similar revolution of the driver pulley. Driver pulley 32 causes driven pulley 34 to rotate therewith by virtue of a timing belt 36 operably engaged therebetween. Driven pulley 34 is provided with a smaller diameter than driver pulley 32, and thus a single revolution of the driver pulley will produce a plurality of revolutions of the driven pulley.

Shaft 38 of driven pulley 34 is connected to rotatable flexible shaft assembly 40 which in turn, is connected to driven flexible shaft 18. Another flexible shaft assembly 42, similar to flexible shaft assembly 40, connects with connecting flexible shaft 24 which articulates with the steering mechanism of the flying bridge. The pulley-belt components may readily be included in a self-contained unit having means for connecting driven pulley shaft 38 to flexible shaft assemblies 40 and 42, or a housing 44, or other suitable shrouding member, may enclose the pulley-timing belt mechanism to protect it from dirt, moisture, and the like.

Figure 3:
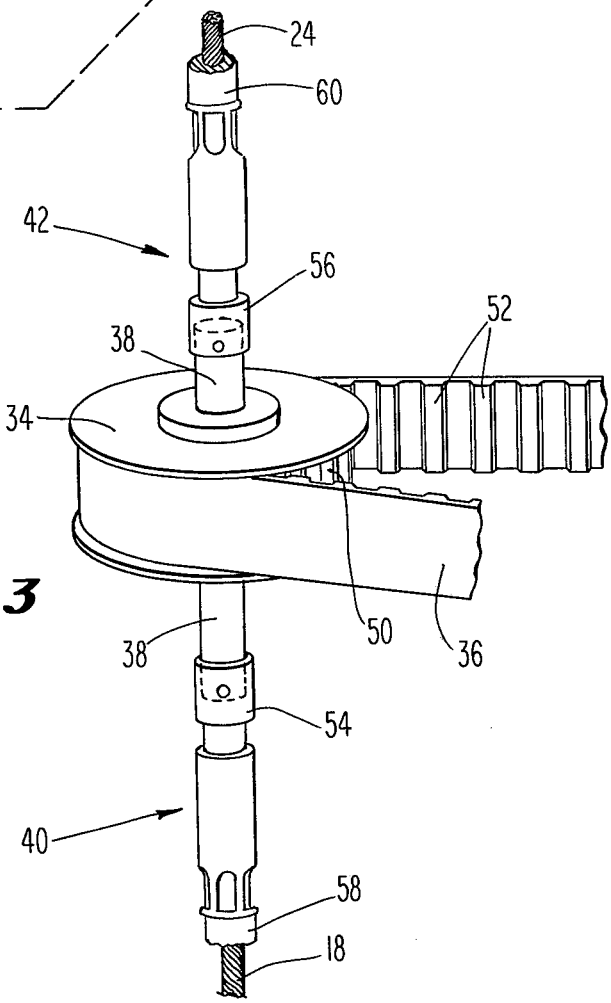
FIG. 3 is a perspective view of an output shaft of the steering mechanism of FIG. 2, which shaft may be driven from main deck dashboard or flying bridge, for example, by means of flexible shafting.

In FIG. 3, driven pulley 34 is provided with spaced teeth 50, as is driver pulley 32. Teeth 50 coact with spaced projections 52 on timing belt 36. The flexible shaft assemblies 40 and 42 are conventional, i.e., shaft 38 is provided with suitable female couplings 54 and 56 which securely hold casings 58 and 60 respectively at their other ends. Casings 58 and 60 permit flexible shafts 18 and 24 respectively to freely rotate therewithin.

Figure 4:
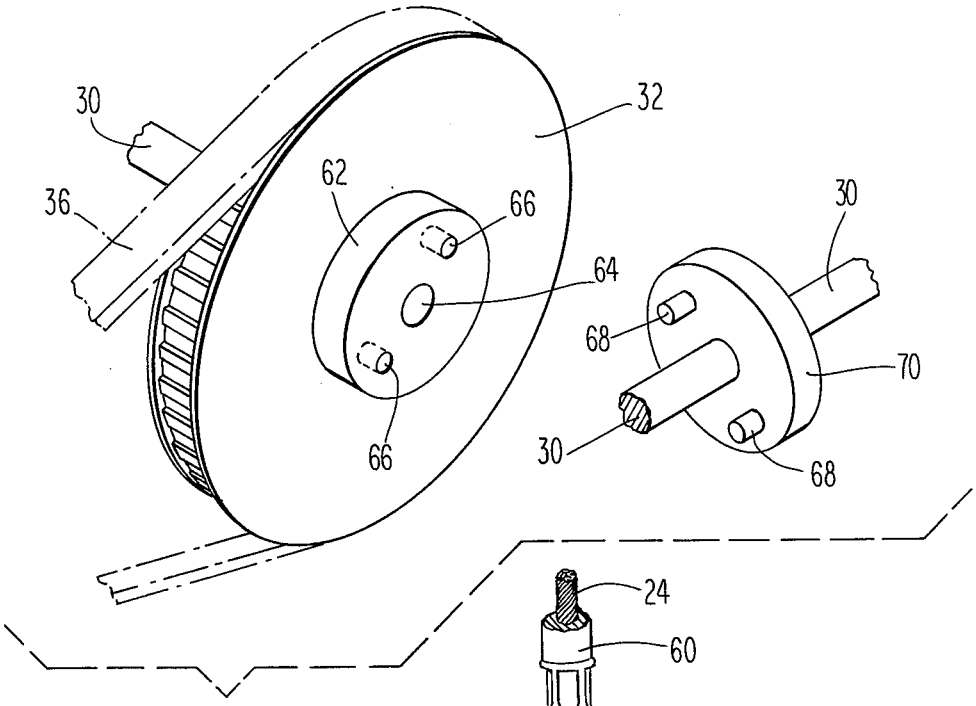
FIG. 4 is a perspective view of several components of the clutch assembly of the present steering system, the components being disassembled and then rotated about 90° for purposes of clarity.

Each steering mechanism of the vessel is provided with a clutch mechanism (FIG. 4). Driver pulley 32 includes a central flange 62 having an axial bore 64 through which shaft 30 passes. Flange 62 includes a pair of recessed bores 66 which receive pins 68 mounted to, or extending from, an upper flange 70 rigidly secured to shaft 30. Thus, when pins 68 are engaged within bores 66, it is apparent that any rotation of shaft 30 when steering wheel 20 is rotated will similarly rotate driver pulley 32 and all pulleys in the vessel's steering system, i.e., at the main deck dashboard, flying bridge, and others, if present.

Disengaging the clutch members will, of course, still permit all pulleys to rotate in each steering mechanism, but since all steering wheels may readily be disengaged when not in use, only that steering wheel which is actually steering the vessel will be engaged.

Figure 5:
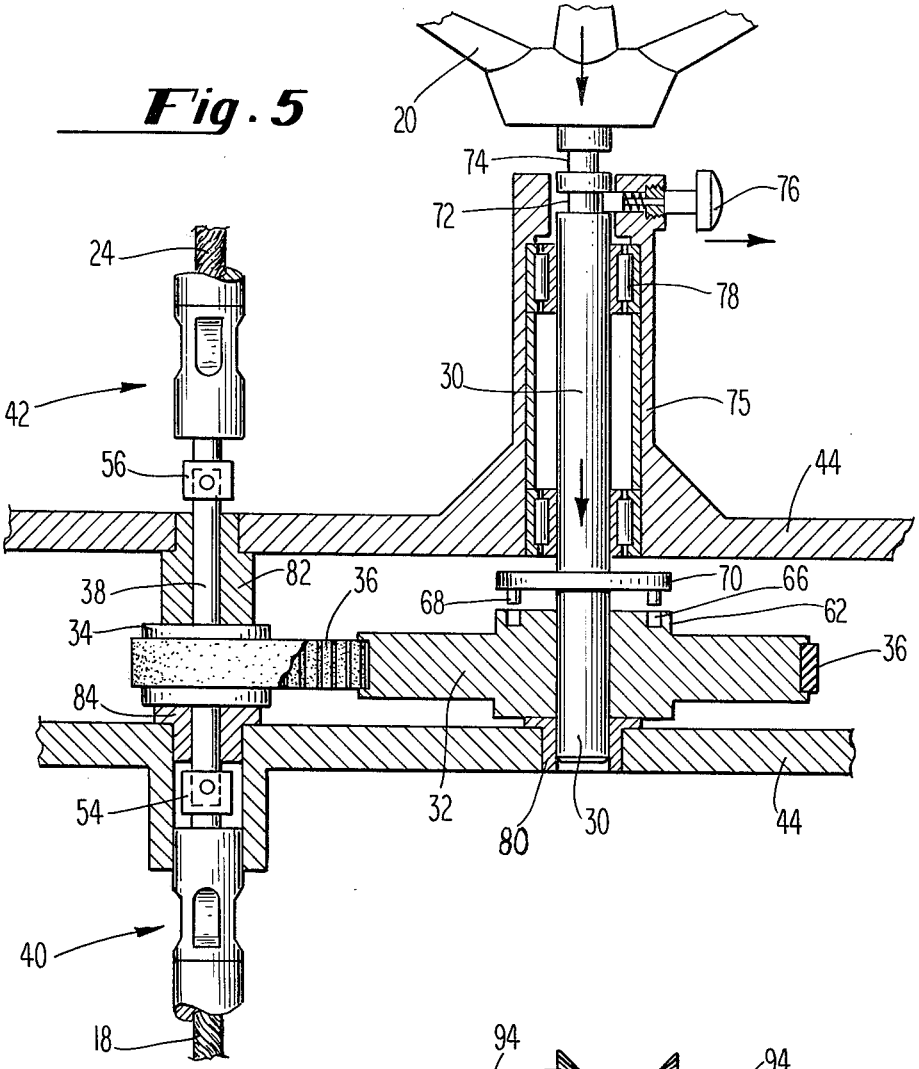
FIG. 5 is a transverse sectional view of the steering system of FIG. 2 and the clutch assembly of FIG. 4.

To that end, a pair of spaced grooved annuli 72 and 74 is provided around steering wheel shaft 30 adjacent inner end of hub 75. A spring-loaded pin 76 penetrates hub 75 to engage groove 72 when the clutch members are disengaged, as shown in FIG. 5. When engagement of the clutch members is desired however, pin 76 will be disengaged from groove 72 with one hand while the other hand merely pushes down or forward on steering wheel 20, approximately $\frac{1}{2}$ to $\frac{3}{4}''$ in practice, until pin 76 engages groove 74. The operator may be required to rotate steering wheel 20 until pins 68 engage bores 66. It will be understood that additional pins and mating bores may be provided in order to facilitate engagement. Intermeshing tooth members may be used advantageously with the present invention in lieu of the pin-type clutch arrangement shown and described.

Steering wheel shaft 30 is rotatably mounted by means of suitable bearings 78 in hub 75. Bushing 80 for steering shaft 30, and bushings 82 and 84 for driven pulley shaft 34 are conventional.

Figure 6:
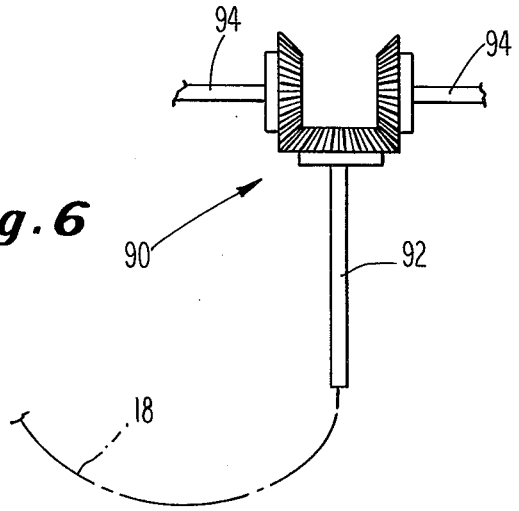
FIG. 6 is a diagrammatic illustration of a T-coupler which couples outputs from two hand-operated steering devices into stem of the coupler which is rotatable by either steering device.

Flexible shaft 18 may optionally be driven from a T-coupling device 90 (FIG. 6). If that end of flexible shaft 18, which is connected to driven pulley shaft 38 is now connected to the stem portion 92 of the device 90 through a conventional flexible shaft end fitting or coupling member, and the outputs from each driven pulley of both steering mechanisms, by means of flexible shafting, is connected to a different end of the cross-bar 94 of T-coupler 90, it is apparent that vessel 10 may readily be steered from either the main deck dashboard or flying bridge. Actual steering by any steering wheel will rotate all pulleys and timing belts, but not any disengaged steering wheel. If each bevel gear of T-coupler 90 is viewed from the direction of the respective arrows, it is apparent that all flexible shafts will rotate either in a clockwise or counterclockwise direction, thus simplifying connections. Additionally, bevel gears could be added to device 90 to accommodate additional decks for steering therefrom, if desired.

I claim:

1. Marine vessel steering apparatus for steering said vessel from a plurality of locations comprising a first steering wheel mounted at a main deck dashboard, a second steering wheel mounted at another location on said vessel, a steering member for steering said vessel, a first rotatable flexible shaft articulating between said steering member and said first steering wheel, each of said steering wheels capable of controlling said steering member through said first flexible shaft, each of said steering wheels cooperating with a pulley-belt system including a driver pulley rotating in response to rotation of respective steering wheel, a driven pulley, belt means operably engaged about said driver and driven pulleys whereby rotation of said first steering wheel rotates said first flexible shaft to control said steering member, each of said driven pulleys having a shaft secured thereto, said driven pulley shafts having an input end and an output end, a second rotatable flexible shaft connected between said output end of said driven pulley cooperating with said second steering wheel and said input end of said driven pulley cooperating with said first steering wheel, means for disengaging either of said steering wheels from its respective driver pulleys whereby rotation of said steering wheel engaged to its respective driver pulley rotates each of said flexible shafts to control said steering member.

2. Apparatus of claim 1 wherein said disengaged steering wheel remains motionless in response to rotation of said engaged steering wheel.

3. Device of claim 2 wherein said means for disengaging either of said steering wheels comprises a shaft connected to and rotating in response to rotation of each of said steering wheels, cooperating interlocking means secured to each of said steering wheel shafts and each of said driver pulleys for rotating said driver pulleys in accordance with rotation of said steering wheels, and means for separately releasing either of said cooperating interlocking means.

* * * * *